343/700MS

United States Patent [19]
Makimoto et al.
[11] 4,398,199
[45] Aug. 9, 1983

[54] CIRCULARLY POLARIZED MICROSTRIP LINE ANTENNA

[76] Inventors: Toshio Makimoto, 15-3, Shinsenrinishimachi 2-chome, Toyonaka-shi, Osaka; Sadahiko Nishimura, 2-51, Tamatsukurimotomachi, Tennoji-ku, Osaka, both of Japan

[21] Appl. No.: 240,610

[22] Filed: Mar. 5, 1981

[30] Foreign Application Priority Data

Mar. 10, 1980 [JP] Japan ..... 55-30797

[51] Int. Cl.³ ..... H01Q 1/38
[52] U.S. Cl. ..... 343/700 MS
[58] Field of Search ..... 343/700 MS, 846, 829

[56] References Cited

U.S. PATENT DOCUMENTS 4,160,976 7/1979 Conroy ..... 343/700 MS
4,335,385 6/1982 Hall ..... 343/700 MS

*Primary Examiner*—Eli Lieberman
*Attorney, Agent, or Firm*—Wenderoth, Lind & Ponack

[57] ABSTRACT

A circularly polarized microstrip line antenna for receiving or transmitting a signal of a particular wavelength includes a dielectric substrate having a ground plate provided on one surface thereof and having a microstrip line formed on another surface thereof. The microstrip line has an omega shaped fundamental portion composed of a loop portion and a pair of straight portions. The loop portion is one of either a regular polygon or a continuous closed curve having a length equal to the particular wavelength. The loop portion is symmetric about an axis which is on one of the surfaces of the substrate and is at right angles to the straight portions of the microstrip line.

3 Claims, 15 Drawing Figures

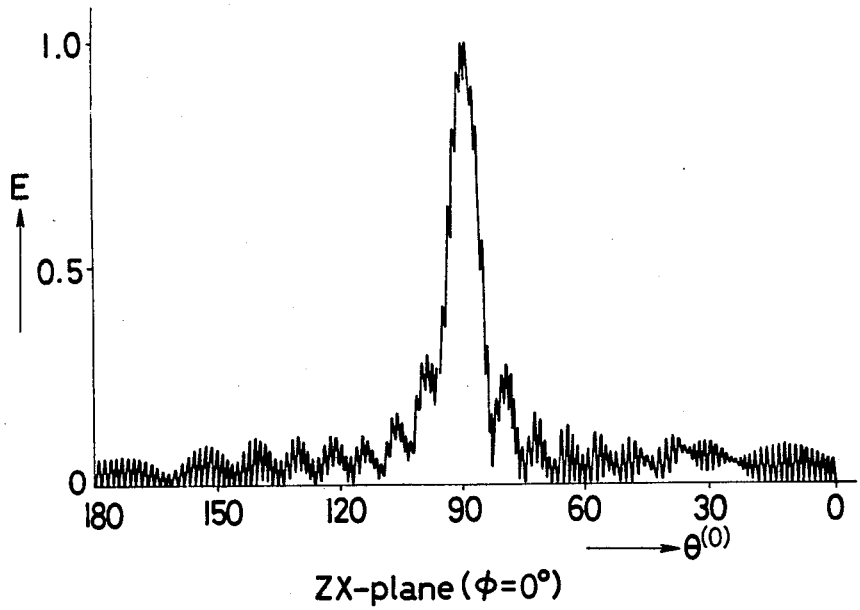
Fig. 5
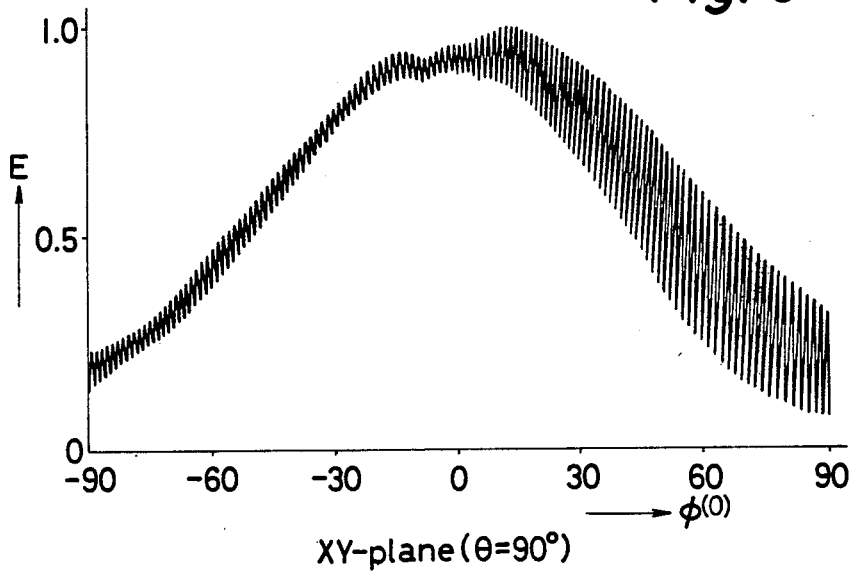

CIRCULARLY POLARIZED MICROSTRIP LINE ANTENNA

BACKGROUND OF THE INVENTION

1. Field of the Invention

The present invention generally relates to an antenna, and more particularly, to a circularly polarized antenna employing a microstrip line.

2. Description of the Prior Art

Commonly, in radar equipment, microwave communication, satellite communication or receipt of satellite broadcasting signal, etc., beam antennas of high gain with respect to circularly polarized waves are frequently required. For the circularly polarized antennas described above, turnstile antennas, helical antennas, paraboloid reflector antennas, and conical antennas, have been used. However, the known antennas as described above have such disadvantages that they generally occupy a three-dimensional space and tend to be complicated in structure, with consequently large volumes and comparatively heavy weights, thus resulting not only in high cost, but resulting in difficulties during the installation thereof, while presenting configurations which are relatively weak against wind pressures.

SUMMARY OF THE INVENTION

Accordingly, it is an essential object of the invention to provide an improved microstrip line antenna in which transmission and reception of the circularly polarized waves are made possible by the antenna of flat plate type through the utilization of a microstrip line formed on a flat plate member or substrate.

It is another important object of the invention to provide an improved microstrip line antenna of the above described type which is light in weight and readily installed, and having a sufficient strength against wind pressures and the like, with substantial elimination of drawbacks inherent in the conventional antennas of this type.

To accomplish the foregoing objectives, there is provided a circularly polarized microstrip line antenna which comprises a dielectric substrate having a ground plate plovided on its one surface, and a microstrip line formed on the other surface thereof, said microstrip line including a purality of loop conductors aligned in a straight line at the same orientation, each of said loop conductors being formed into a loop having a peripheral length approximately equal to a guide wavelength $\lambda g$, with a a lead-in end and a lead-out end into and from said loop being electrically insulated through a predetermined interval, and linear conductors connecting the lead-in ends and lead-out ends of the respective neighboring loop conductors so as to constitute the microstrip line for passing travelling waves along said microstrip line.

As is clear from the foregoing description, according to the invention, since the circularly polarized antenna can be formed on the flat plate, not only is the construction of the antenna simplified, with consequent facilitation in the manufacture thereof, but the strength of the antenna against wind pressures and the like is increased as compared with the conventional parabolic antennas and other antennas for circularly polarized waves, while simultaneously, the installation thereof is appreciably facilitated. Furthermore, owing to the fact that the circularly polarized microstrip line antenna of high gain according to the present invention showing the one side directivity characteristics, the antenna may be produced by employing a selective photoetching technique on the dielectric substrate, and the antenna has numerous advantages such as suitability for mass production, slim and thin configuration and light weight, etc.

BRIEF DESCRIPTION OF THE DRAWINGS

A detailed description of the invention will be made with reference to the accompanying drawings, which are to scale. Like numerals designate corresponding parts in the several figures.

FIG. 4 is a graphical diagram representing radiation field patterns in the ZX-plane as actually measured with the employment of the antenna of FIG. 1;

FIG. 5 is a graphical diagram similar to FIG. 4, but particularly shows radiation field patterns in the XY-plane as actually measured with the employment of the antenna of FIG. 1;

DETAILED DESCRIPTION OF THE PREFERRED EMBODIMENT

Figure 1:
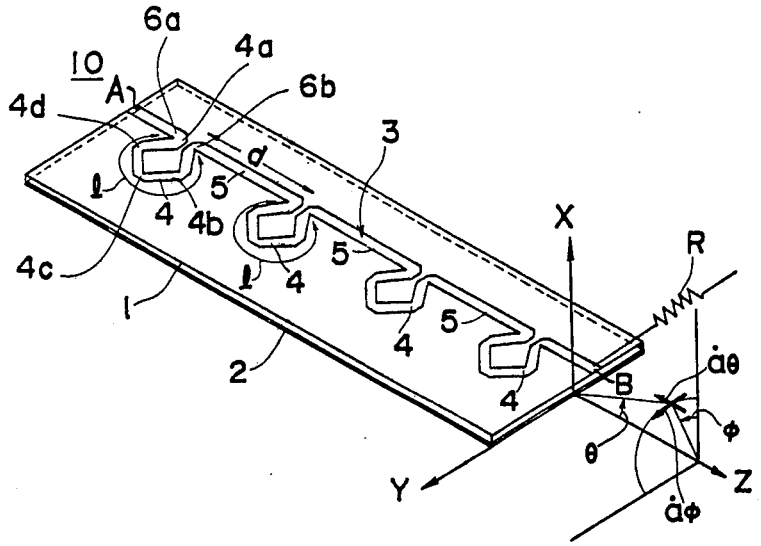
FIG. 1 is schematic perspective view showing the construction of a circularly polarized microstrip line antenna according to one preferred embodiment of the present invention, together with the co-ordinate system thereof.

The following detailed description is of the best presently contemplated mode of carrying out the invention. This description is not to be taken in a limiting sense, but is made merely for the purpose of illustrating the general principles of the invention since the scope of the invention best is defined by the appended claims.

Referring now to the drawings, one aspect of the invention will be described hereinbelow with reference to the accompanying figures.

Figure 2:
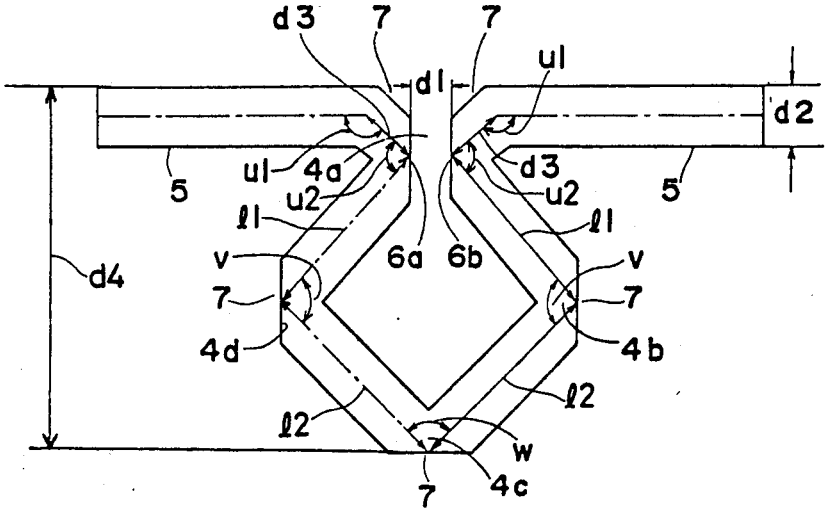
FIG. 2 is a schematic top plane view showing, on the enlarged scale, the detailed structure of a loop conductor employed in the arrangment of FIG. 1.

As shown is FIGS. 1 and 2, the antenna according to the invention generally includes a base plate or substrate 1 made of a flat plate-like dielectric member of a suitable thickness, a ground plate 2 provided over the entire reverse surface of the substrate 1, and a microstrip line 3 formed by electrical conductors and formed on the front surface of said substrate 1.

the microstrip line 3 as described above further includes a plurality of loop conductors 4 aligned on said front surface in a straight line at the same orientation, through a predetermined interval therebetween, and linear conductors 5 which connect the respective neighboring loop conductors 4. Each of the loop conductors 4 of, for example, a square configuration as shown has its one angle 4*a* (i.e. one corner thereof) generally directed to the the corresponding linear conductor 5, with a diagonal line which passes through another angle 4*c* confronting said angle 4*a* being arranged to be at right angles with respect to the direction of extention of said linear conductor 5, while, at the angle 4*a*, a lead-in end 6*a* and a lead-out 6*b* of the loop conductor 4 is spaced by a predetermined interval d1 for electrical insulation therebetween. The length l between the lead-in end 6*a* and lead-out end 6*b* of the loop conductor 4 is set to have a guide wavelength λg approximately corresponding to the wavelength of the frequencies to be dealt with. Furthermore, the length of the linear conductor 5 which connects one of the loop conductors 4 with the neighboring loop conductor 4 is also set to have the guide wavelength λg so that the direction for transmission or reception (i.e. direction of the main beam) is directed at right angles with respect to the substrate 1.

In the antenna according to the invention, the travelling waves are propagated through the microstrip line 3, and in this respect, the corner portion of the loop conductor 4 is removed as shown at 7 in FIG. 2 for preventing generation of reflected waves at the corners 4*b* to 4*d*, and also at the lead-in end 6*a* and lead-out end 6*b* of each of the loop conductors 4 during the advancing of the travelling waves.

One example of dimentions, etc. at each part of the antenna of FIG. 1 is shown hereinbelow.

(a) material of the substrate 1: Rexolite 1422 (TM of OAK Company in U.S.A.) relative dielectric constant $\epsilon_\gamma$: 2.53
(b) thickness of the substrate 1: 0.79 mm
(c) width of the substrate 1: 30 mm
(d) width d2 of the microstrip line 3: 2 mm
(e) length l1 of loop conductor 4: 6.5 mm
(f) length l2 of loop conductor 4: 7.0 mm
(g) distance $d_1$ between the lead-in end 6*a* and lead-out end 6*b*: 1.4 mm
(h) distance $d_3$ between the end of the line conductor 5 and the lead-in end 6*a* (lead-out end 6*b*): 2 mm
(i) angle u1 made by the line conduction 5 and the line reaches from the line conductor to the lead-in end 6*a* (lead-out end 6*b*): 139°
(j) angle u2 made by the lead-in end 6*a* and lead-out end 6*b*: 90°
(k) angle V of the corner 4*b* (4*d*): 94°
(l) angle W of the corner 4*c*: 90°
(m) length $d_4$ from the end of the line conductor 5 to the corner 4*c*: 12.2 mm It is to be noted here that the microstrip line 3 as described in the foregoing is formed, for example, by selectively photoetching a printed conductor applied on the printed substance.

In the antenna having the construction as described above, coaxial connectors are attached to opposite ends in the longitudinal direction of the substrate 1, and one end A is set to be a feeding point, while a matching load R with respect to the characteristic impedance (50Ω) of the microstrip line 3 is connected to the other end B. By the above arrangement, upon feeding of high frequency currents such as microwaves having a wavelength λo from the one end A, travelling waves with the guide wavelength λg pass through the microstrip line 3 by way of a path reaching the matched load R sequentially through the first line conductor 5, lead-in end 6*a* of the loop conductor 4, lead-out end 6*b*, subsequent line conductor 5, and further through the neighboring loop conductor and other loop conductors 4. By the above travelling waves, right-hand circularly polarized waves are produced from each of the loop conductors 4 in a direction at right angles with respect to the surface of the substrate 1.

Now, the principle of operation for radiation of the circularly polarized waves by the antenna as described so far, is explained with reference to the co-ordinates in FIG. 1. Since the microstrip line antenna (referred to as the MSL antenna hereinbelow) of the above described type is arranged to operate as a travelling-wave antenna by bending a microstrip line periodically, an explanation will be given hereinbelow by the equivalent current method in which the radiation is regarded to be effected equivalently from a high frequency current source flowing along the microstrip line.

Figure 3:
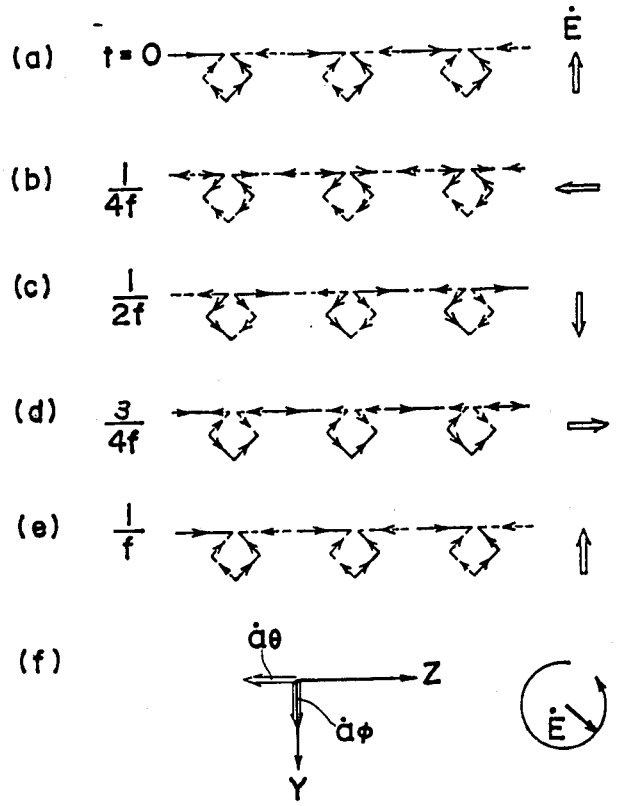
FIG. 3 is schematic diagram showing instantaneous current on the microstrip line in the embodiment of FIG. 1 for illustrating the state of generation of the circularly polarized waves.

Upon feeding of the high frequency current to the microstrip line constituted by the lines and squares from the feeding point A shown in FIG. 1, the direction of the current is being reversed at every $\lambda g/2$ when such a current direction is shown with respect to a certain instant of time. The state as described above is illustrated in FIG. 3 by solid lines and dotted lines together with arrows. The MSL antenna radiates electromagnetic waves directed in the same direction as that of the high frequency current on the microstrip line and having a magnitude proportional thereto. Accordingly, the resultant electric field $\dot{E}$ of the electromagnetic waves radiated from each side of the loop conductor in the square shape is in the direction as shown in FIG. 3 (a) at a certain period of time t=0, when observed at an infinite point. Subsequently, the direction of the instant current after an elapse of the time t by ¼f is shown in FIG. 3 (*b*), wherein f represents the frequency employed. In the above case, the resultant electric field $\dot{E}$ is rotating in the counterclockwise direction with respect to the antenna as illustrated. Upon a further elapse of time, as shown in FIGS. 3 (*c*) to 3 (*e*), the resultant electric field $\dot{E}$ of the electromagnetic waves radiated from the loop conductors 4 rotates, after all, in the counterclockwise direction with time, as observed facing the antenna so as to complete one rotation during a time period of 1/f.

Meanwhile, the resultant electric field $\dot{E}$ for each of the loop conductors in the direction normal to the surface of the substrate 1, is represented as follows:

$$\dot{E}=K(\dot{a}_\theta N_\theta+\dot{a}_\phi N_\phi)e^{j\omega t} \quad (1)$$

Where K is a proportionality constant, $\omega$ is an angular frequency, and $\dot{a}\theta$ and $\dot{a}\phi$ are unit vectors in the $\theta$ and $\phi$ directions respectively.

$$N_\theta=\frac{1}{\sqrt{2}}\,\mathrm{Sin}\left(\frac{\beta}{2}(d+l)\right)-\frac{1+\sqrt{2}}{2}\,\mathrm{Sin}\left(\frac{\beta l}{2}\right)+\mathrm{Sin}\left(\frac{\beta l}{4}\right),$$

$$N_\phi=-j\sin^2\left(\frac{\beta l}{4}\right),$$

$$\beta=2\pi/\lambda g$$

When $l=\lambda g$ and $d=\lambda g$, the equation (1) is simplified as follows:

$$\dot{E}=K\{\dot{a}_\theta e^{j\omega t}+\dot{a}_\phi e^{j(\omega t-\frac{\pi}{2})}\} \quad (2)$$

The resultant electric field $\dot{E}$ represented by the equation (2) is constant in amplitude and uniformly rotates with respect to time in the direction normal to the surface of the substrate 1, at the rotational speed of one rotation per each cycle.

Therefore, the electromagnetic waves radiated from the square loop conductors 4 of FIG. 1 are emitting right-hand circularly polarized waves with time. In the above case, since the length of the line conductor 5 is $\lambda g$, the circularly polarized waves to be radiated from the respective loop conductors will be in phase in the direction normal to the surface of the substrate 1 for addition to each other. On the other hand, the result of the radiation intensity from the line conductors 5 becomes zero in the direction normal to the surface of the substrate 1. Therefore, it may be regarded that a linear array antenna is constituted thereby in which the loop conductors 4 operate as the circularly polarized radiator, while the linear portions are serving as a transmission line.

It should be noted here that, in the foregoing embodiment, although the present invention is mainly described with reference to the transmitting antenna, the concept of the present invention is not limited to such a transmitting antenna alone, but may readily be applied to a circularly polarized wave receiving antenna as well.

As is seen from the foregoing description, the main beam from the square loop conductors shows the radiation only in the direction towards the surface of the substrate 1 on which the microstrip line 3 is provided, with almost no radiation of the electromagnetic waves, in the direction towards the reverse surface of said substrate 1 which is supplied with the ground conductor 2, and thus, a construction which is favorable to effect a one side directivity characteristic has been achieved.

Results of experiments performed by the inventors of the invention on the MSL antenna described so far will be given hereinbelow. FIGS. 4 and 5 respectively show a ZX-plane radiation field pattern and an XY-plane pattern at the frequency f=9.48 GHz, with the number of loop conductors set to be 12. The MSL antenna according to the invention is employed to receive the electromagnetic waves transmitted from a second antenna which is rotated mechanically in a plane normal to the imaginary straight line between the both antennas. Favorably circularly polarized wave characteristics are shown at an axis ratio AR=1.06. Other observation values were such that the gain in the main beam direction ($\theta=90°$, $\phi=0°$) was 15.7 dBi (i indicates a ratio with respect to an isotropic radiator) with beam widths being 6.4° in the ZX-plane and 84.0° in the XY-plane, while sidelobe level in the ZX-plane was −11.3 dB. From the foregoing characteristics, it is seen that the antenna of the invention has superior circularly polarized wave characteristics. Given hereinbelow is other data which was obtained.

(a) frequency f=9.48 GHz
(b) free space wavelength $\lambda_0=31.62$ mm
(c) guide wavelength $\lambda_g=21.50$ mm (effective wavelength reduction rate $\eta=\lambda g/\lambda 0=0.68$)
(d) gain G=15.7 dBi
(e) Gain-beamwidth product 20,000
(f) VSWR (voltage standing wave ratio) $\sigma=1.20$
(g) Dissipated power in the load −10 dB (10%)
(h) matched load 50Ω

Figure 6:
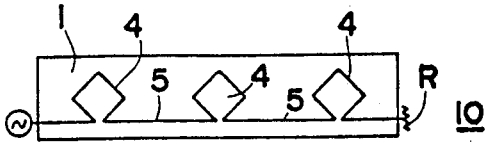
FIG. 6 is a schematic top plane views showing a modification of the arrangement of FIG. 1 according to the invention.
Figure 7:
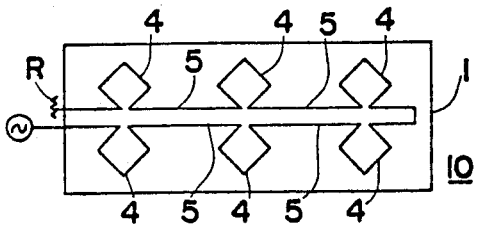
FIG. 7 is a schematic top plane view showing another modification of the arrangement of FIG. 1 according to the invention.
Figure 8:
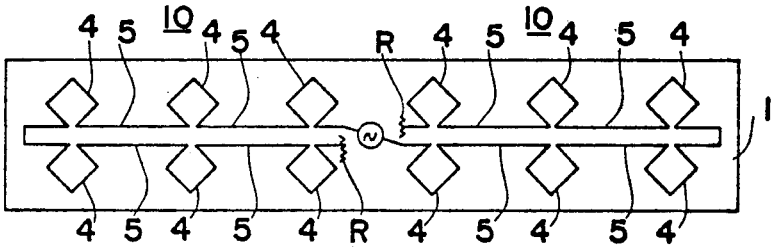
FIG. 8 is a schematic top plane view showing another modification of the arrangement of FIG. 1 according to the invention.

It is to be noted here that, in the foregoing embodiment, the present invention is entirely described with reference to the transmitting antenna for the right-hand circularly polarized waves, the arrangement may be modified to transmitting and receiving antennas for left-hand circularly polarized waves as well, by combining the winding and feeding direction of the loop conductors 4 of the MSL antenna 10 of FIG. 1 in the manner as shown in FIG. 6, or modified as shown in FIG. 7 in which the microstrip line provided with the loop conductors 4 as described earlier is folded back on the way to from the MSL antenna 10 with two rows of square loops, in which case, similar functioning may be achieved, with an improved radiating efficiency. Moreover, the arrangement of the invention is modified with respect to a pair of MSL antennas 10 and 10 symmetrically aligned laterally as shown in FIG. 8 for feeding (or reception) at the central portion thereof.

Furthermore, it is possible to further modify the arrangement of the invention into a planar array antenna in which a plurality of rows of antennas are provided as desired.

Figure 10:
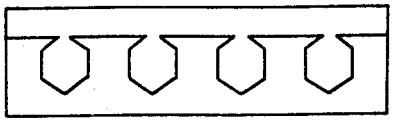
FIG. 10 is a schematic top plane view showing still another modification of the arrangement of FIG. 1 according to the invention.
Figure 11:
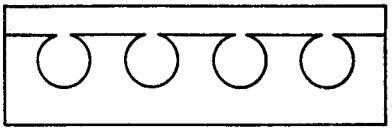
FIG. 11 is a schematic top plane view showing another modification of the arrangement of FIG. 1 according to the invention.

It should also be noted that, in the foregoing embodiments, the description of the invention is mainly given with reference to the case where the MSL antenna having the loop conductors in the square configuration radiates the circularly polarized waves in the direction normal to the array axis, but when the main beam is directed in the same direction, the loop conductors may be modified, in the configuration thereof, into a regular polygon as shown in FIG. 10 or a circle as shown in FIG. 11 besides the square shape, with the same operations achieved.

Description will be made hereinbelow with reference to the case where the direction of the main beam is generally directed at any angles as desired, with respect to the surface of the substrate 1. On the assumption that the direction of the main beam with respect to the substrate 1 is represented by $\phi m$, the electromagnetic wave radiated from each of the loop conductors 4 in FIG. 1 are in phase and added to each other when the following equation is satisfied.

$$kd \cos \theta_m - \beta(1+d) = 2n\pi \quad (3)$$

where $k = 2\pi/\lambda 0$ $\beta = 2\pi/\lambda g$, and n represents an integer.

The peripheral length l of the loop conductor 4 is set to be $l = \lambda g$, and $n = -2$, then the length d of the line conductor 5 is as follows:

$$d = \lambda_g/(1 - \eta \cos \theta_m) \quad (4)$$

Where $\eta$ is the effective wavelength reduction rate of the microstrip line. In the above case, the configuration of the loop is arranged to be a regular polygonal shape or a deviated polygonal shape (i.e. a shape arranged for a decrease of $\alpha$ in FIG. 9) obtained, for example, by crushing a regular polygon or a circle in the direction of extension of the microstrip line, or to be an ellipse. Reverting back to the case where the loop conductors 4 have the rectangular configuration, the shape will becomes a square at $\theta m = 90°$ and a rhombic configuration at $\theta m \neq 90°$.

Figure 9:
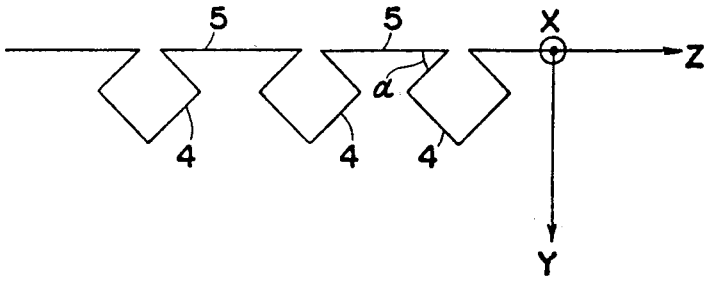
FIG. 9 is a schematic top plane view showing still another modification of the arrangement of FIG. 1 according to the invention.
Figure 14:
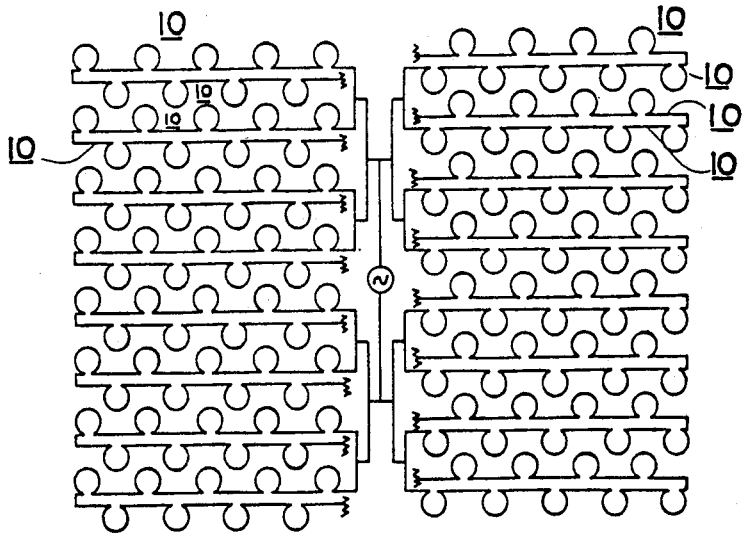
FIG. 14 is a schematic plane view showing another modification of the arrangement of FIG. 1 according to the invention.

When the peripheral length l of the rhombic loop conductor is chosen to be $l = \lambda g$, the electric field at a far distance E is $$\dot{E} = K1(\hat{a}_\theta N1_\theta + \hat{a}_\phi N1_\phi)e^{j\omega t} \quad (5)$$

where K1 is a proportionality constant, $$N1_\theta = \sin\theta \cdot \cos\alpha \cdot \cos\left(\frac{\pi}{2}\eta \cdot \cos\theta \cdot \cos\alpha\right), \text{ and}$$

$$N1_\phi = -j\sin\alpha\left\{1 - \eta\cos\theta \cdot \cos\alpha \cdot \sin\left(\frac{\pi}{2}\eta \cdot \cos\theta \cdot \cos\alpha\right)\right\}$$

where $\alpha$ is the angle as shown in FIG. 9.

Circularly polarized wave is radiated in a given main beam direction $\theta m$ when $$|N1_\theta| = |N1_\phi|$$

and thus $$\sin\theta_m \cdot \cot\alpha \cdot \cos\left(\frac{\pi}{2}\eta \cdot \cos\theta_m \cdot \cos\alpha\right) + \eta\cos\theta_m \cdot \cos\alpha \cdot \sin\left(\frac{\pi}{2}\eta \cdot \cos\theta_m \cdot \cos\alpha\right) - 1 = 0 \quad (6)$$

The above formula is solved with reference to $\alpha$ by imparting the value $\theta m$ thereto. $\alpha$ denotes the conditions for radiating the circularly polarized waves in the direction of $\theta m$.

Figure 15:
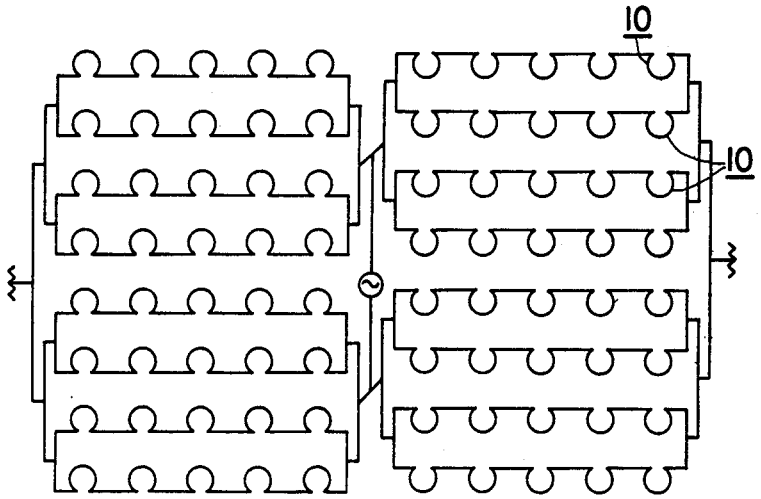
FIG. 15 is a schematic plane view showing further modification of the arrangement of FIG. 1 according to the invention.
Figure 12:
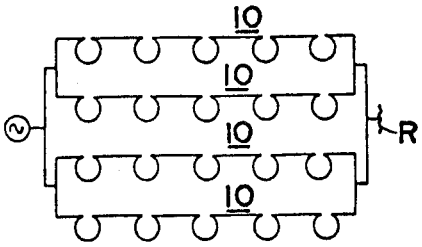
FIG. 12 is a schematic top plane view showing further modification of the arrangement of FIG. 1 according to the invention.
Figure 13:
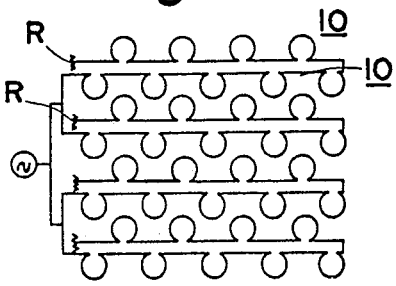
FIG. 13 is a schematic top plane view showing still further modification of the arrangement of FIG. 1 according to the invention.

Referring to FIGS. 12 to 15, there are shown further modifications of the arrangement according to the invention. In the modification of FIG. 12, a plurality of rows of the MSL antennas 10 having the construction as described in the foregoing are arranged in parallel on the same substrate for the one end feeding, and in FIG. 13, the MSL antennas 10 are provided to be folded back, while in the modification of FIG. 14, the MSL antennas 10 constituted as described above are provided laterally in pairs on the flat plane, and folded back for each row to be formed into a multi-array shape for feeding at the central portion. FIG. 15 is similar to FIG. 14, but it should be noted that a pair of MSL antenna 10 are paralled to each other.

It should be noted that according to the invention, the terminal ends may be open-circuit in the case where the number of loop conductors is large, and also that the ground conductor is not necessarily provided on the entire reverse surface of the substrate 1, but may be of a strip-like configuration disposed along the microstrip line provided on the surface of the substrate.

What is claimed is:

1. A circularly polarized microstrip line antenna for receiving or transmitting a signal of a particular wavelength comprising:

a dielectric substrate having a ground plate provided on one surface thereof and having a microstrip line formed on another surface thereof;

wherein said microstrip line has an omega shaped fundamental portion composed of a loop portion and a pair of straight portions;

and wherein said loop portion is a regular polygon having a length $\lambda g$ equal to said particular wavelength;

and wherein said loop portion is symmetrical about an axis which is on one of said surfaces of said substrate and is at right angles to said straight portions of said microstrip line;

and wherein an angle $\alpha$ is defined by one of said pair of straight portions and a side of the polygon connected to said straight portion, said angle $\alpha$ being obtained by the equation:

$$\sin\theta m \cdot \cot\alpha \cdot \cos\left(\frac{\pi}{2}\eta \cdot \cos\theta_m \cdot \cos\alpha\right) + \eta\cos\theta_m \cdot \cos\alpha \cdot \sin\left(\frac{\pi}{2}\eta \cdot \cos\theta_m \cdot \cos\alpha\right) - 1 = 0$$

where $\theta_m$ is the direction of a main beam of said antenna and $\eta$ is an effective wavelength reduction rate thereof;

and wherein a total length of said pair of straight portions d is obtained by the equation:

$$d = \lambda g/(1 - \eta \cos \theta_m).$$

2. A circularly polarized microstrip line antenna according to claim 1, wherein said loop portion is a square.

3. A circularly polarized microstrip line antenna according to claim 1, wherein said loop portion is a hexagon.

* * * * *